United States Patent [19]

Caveney et al.

[11] Patent Number: 4,983,130

[45] Date of Patent: Jan. 8, 1991

[54] INSULATION DISPLACEMENT CONTACT

[75] Inventors: Jack E. Caveney, Hinsdale; John J. Bulanda, New Lenox; Russell E. Wende, Oak Lawn, all of Ill.

[73] Assignee: Panduit Corp., Tinley Park, Ill.

[21] Appl. No.: 785,817

[22] Filed: Oct. 9, 1985

[51] Int. Cl.[5] ..... H01R 4/24

[52] U.S. Cl. ..... 439/407

[58] Field of Search ..... 339/97 R, 97 P, 98, 339/99 R

[56] References Cited

U.S. PATENT DOCUMENTS

| | | | |
|---|---|---|---|
| 3,760,331 | 9/1973 | Furley | 339/97 P |
| 3,867,005 | 2/1975 | Hoppe, Jr. | 339/98 |
| 4,344,665 | 8/1982 | Racilla et al. | 339/99 R |
| 4,435,035 | 3/1984 | Berry et al. | 339/99 R |

*Primary Examiner*—Joseph H. McGlynn

*Attorney, Agent, or Firm*—Charles R. Wentze; Mark D. Hilliard

[57] ABSTRACT

A one-piece miniature insulation displacement contact adapted for post-termination insertion and retention within a channel of an insulative connector housing. The contact includes a continuous channel extending the length of a conductor termination portion formed at one end of the contact, extending the length of a transition portion of the contact, and extending a portion of the length of a terminal engagement portion of the contact; a floor of the continuous channel extending the entire length of the contact. The conductor termination portion includes opposing first walls coextensive with the floor and opposing insulation displacement jaws shear formed from each of the first walls where each of the jaws is displaced inwardly to juxtapose respective innermost insulation piercing edges of each of said jaws to form an insulation displacement slot.

5 Claims, 1 Drawing Sheet

INSULATION DISPLACEMENT CONTACT

TECHNICAL FIELD

The present invention relates to miniature insulation displacement contacts that are initially mechanically and electrically terminated with conductors and then inserted into respective channels of an insulative housing to form a connector.

BACKGROUND OF THE INVENTION

The increasing demand for a reduction in size of electrical connectors dictates a search for a miniature insulation displacement contact that can be inexpensively manufactured while concomitantly possessing the desirable characteristics of high strength and resiliency.

Two proposed types of miniature insulation displacement contacts are disclosed in U.S. Pat. No. 4,243,286 issued to Brown et al. and U.S. Pat. No. 4,385,794 issued to Lucius. Both of these proposed contacts teach the application of indents or embossments to upstanding insulation piercing jaw members to strain harden the jaw members to increase their rigidity and strength in order to prevent termination induced buckling and bending deformation of the jaw members. The application of indents or embossments to the insulation piercing jaw members increases the manufacturing complexity and cost of each contact and by increasing the rigidity of the jaw members the indents or embossments necessarily decrease the resiliency of the insulation displacement jaw members; resilient insulation displacement jaw members being desirable to insure that a terminated conductor remains in electrical and mechanical contact with the insulation displacement jaws in the face of varying environmental stresses experienced by the contact during use, such as vibrational forces and temperature cycles.

The contacts suggested by Brown et al. and Lucius also require the application of lateral support to the piercing jaw members during termination of a conductor therebetween to prevent damage to the contact, Brown et al. requiring termination within a connector housing channel and Lucius requiring the use of special termination tooling as seen in FIG. 3 of Lucius.

Both Brown et al. and Lucius teach the use of a contact having a flat cantilever portion for connecting the insulation displacement portion of each contact with the terminal engagement portion of each contact. Such a flat cantilever connecting portion is not sufficiently strong to insure that axial deformation of the contact during termination and/or insertion of the contact within a connector housing is prevented. Thus, termination of such a contact or post termination insertion of such a contact into a connector housing can result in axial deformation of the contact about the planar cantilever portion of the contact.

Although different types of miniature contacts have been proposed, none disclose or suggest a miniature contact that has sufficient strength to successfully pierce the insulation of a conductor while retaining substantially all of its resiliency to effect reliable termination of a conductor therein, that can be terminated outside of a connector housing without the use of special tooling to provide lateral support, that effectively resists axial deformation during termination and insertion of the contact within a connector housing, and that presents a gradually tapering profile to facilitate insertion of a contact within the housing.

SUMMARY OF THE INVENTION

It is therefore an object of this present invention to provide a one-piece miniature contact having insulation displacement jaws that have sufficient strength to pierce the insulation of a conductor inserted therein while retaining their resiliency to reliably retain mechanical and electrical contact with the conductor.

It is another object of the present invention to provide a one-piece miniature contact that can be effectively terminated outside the connector housing and in the absence of special lateral support tooling with a minimum of conductor insertion force.

It is an additional object of the present invention to provide a one-piece miniature contact having increased resistance to axial deformation during temination and/or insertion of the contact.

It is a further object of the present invention to provide a one-piece miniature contact that is easily insertable into a connector housing channel after insertion of a conductor within the insulation displacement section of the contact.

It is another object of the present invention to provide a one-piece miniature contact that can effectively terminate conductors having a range of diameters.

It is an additional object of the present invention to provide a one-piece miniature electrical contact that can be simply and economically manufactured from a blank having a contour that minimizes internal or facing edges thus simplifying the dies needed to manufacture the contact.

In general, the contact of the present invention includes a floor extending the length of the contact, having a terminal engagement portion formed at one end of the floor. Integrally formed with the floor at its opposite end is a conductor terminator portion which includes opposing first walls coextensive with the floor and opposing insulation displacement jaws each of which is shear formed from each of the walls along a shear edge that is angled with respect to the longitudinal axis of the contact. Each of the jaws are displaced inwardly to juxtapose respective inner most insulation piercing edges of each of the jaws to form an insulation displacement slot with the shear edge of each of the jaws being angled to project towards the floor. The contact includes a transition portion having opposing transition walls integrally connected to the first walls and converging therefrom to integral connection with the terminal engagement portion. The floor, first walls, and the transition walls together form a continuous integral channel that extends from the terminal engagement portion to the opposite end of the contact to effect a contact structure that is resistant to axial deformation during termination and insertion of each contact while providing a structure from which a resilient and high strength insulation displacement contact can be formed.

PREFERRED EMBODIMENT FOR CARRYING OUT THE INVENTION

Figure 1:
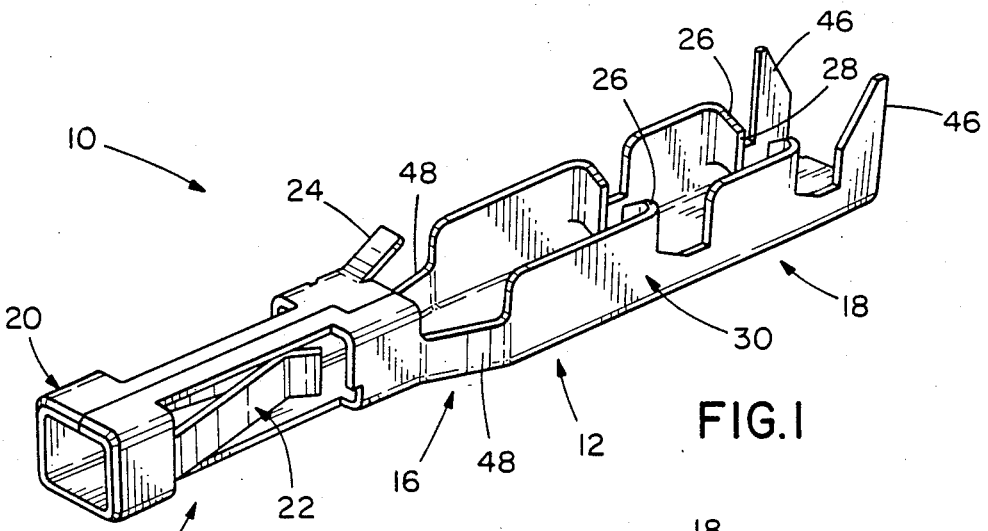
FIG. 1 is a perspective of a contact embodying the concept of the present invention.
Figure 2:
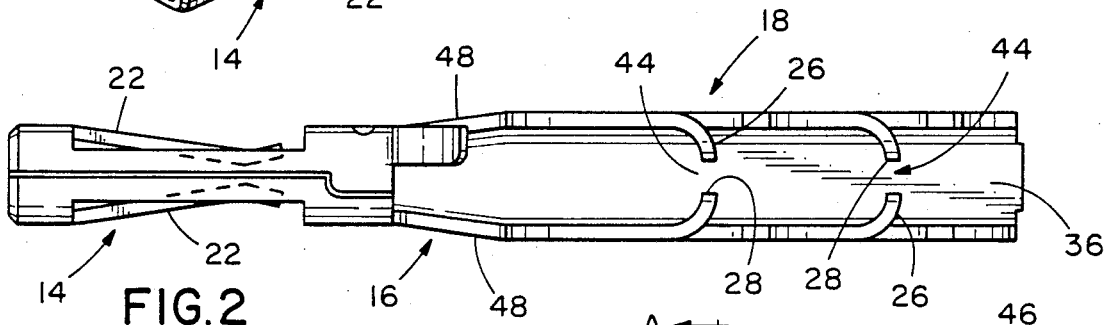
FIG. 2 is a plan of the contact of FIG. 1.
Figure 3:
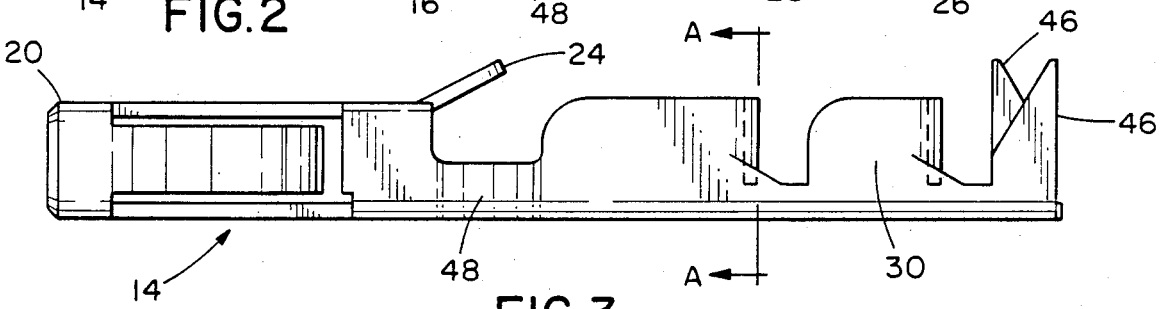
FIG. 3 is a side elevation of the contact of FIG. 1.

A contact embodying the concept of the present invention is designated generally by numeral 10 in the accompanying drawings.

Contact 10 is preferably manufactured from an integral piece of phosphor bronze having a continuous channel 12 extending along the length of contact 10 from an inner portion of a socket portion 14, along a transition portion 16, and along the length of a conductor termination portion 18.

Continuous channel portion 12 integrally connects contact portions 14, 16 and 18 to form a high strength contact that resists axial deformation during termination and insertion of the contact into a connector housing.

Socket portion 14 includes a box-shaped body portion 20 having resilient spring arms 22 and a locking tang 24. Resilient spring arms 22 are secured to the distal end of socket portion 14 and project inwardly into body portion 20; spring arms 22 being disposed to engage a terminal pin inserted within the socket portion to make electrical contact therewith. Tang 24 is positioned projecting away from the distal end of socket portion 14 at an angle that allows easy insertion of contact 10 into a channel of an insulative connector housing; tang 24 being disposed to engage an edge of a window in the insulative connector housing to lock contact 10 within the insulative housing.

Conductor termination portion 18 includes two pairs of insulation displacement jaws 26 which present opposing insulation-piercing edges 28. Each pair of jaws 26 effect independent engagement with a conductor inserted therein to provide redundant termination of the conductor which increases the reliability of contact 10. Insulation displacement jaws 26 are formed by shearing each jaw 26 inwardly from opposing first walls 30 of channel 12 in such a manner as to form an angled shear edge 32 that is substantially parallel to an angled upper edge 34 initially formed in the contact blank.

The provision of sheared angled jaws in the continuous high strength channel 12 provides a contact having high termination strength while retaining substantially all of its resiliency after termination without the need for special strain hardening indentations; provides a contact that resists axial deformation during termination; provides a contact that does not require the use of special lateral support termination tooling; and provides a contact that does not require that the contact be terminated within a laterally supportive connector housing.

Figure 4:
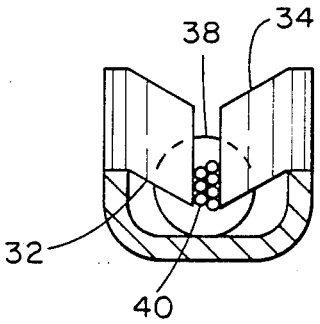
FIG. 4 is a sectional view of insulation displacement jaws of the contact of FIG. 1 taken along line A—A of FIG. 3, shown terminating a small diameter conductor.
Figure 5:
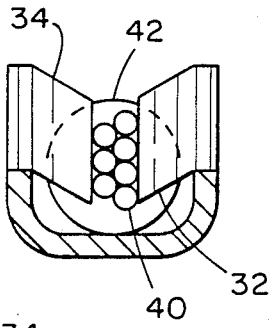
FIG. 5 is a sectional view of insulation displacement jaws of the contact of FIG. 1 taken along line A—A of FIG. 3, shown terminating a large diameter conductor.

The pointed inner portions of jaws 26 project downwardly towards floor 36 to allow the termination of conductors of varying diameters, from a small diamter (28 A.W.G.) wire 38 having multiple conductors 40, depicted in FIG. 4, to a larger diameter (24 A.W.G.) wire 42 having multiple conductors 40, depicted in FIG. 5. Angled disposition of each jaw 26 maximizes the strength of channel 12 by maximizing the height of channel 12 below each jaw 26 while effecting the termination of conductors having a wide range of diameters; the angled tips of jaws 26 projecting towards floor 36 to terminate smaller diameter conductors inserted therein. Angled upper edges 34 of jaws 26 guide a wire to be terminated downwardly into an insulation displacement slot 44 formed by each pair of jaws 26. Conductor termination portion 18 also includes crimpable strain relief tabs 46 that can be deformed to secure the insulation of a conductor to contact 10 to provide strain relief.

In preferred form, contact 10 is formed with conductor termination portion 18 having a greater width than socket portion 14. Walls 30 of conductor termination portion 18 are joined to socket portion 14 by converging walls 48. Walls 30, converging walls 48, and floor 36 form continuous channel 12 connecting socket portion 14, transition portion 16 and conductor termination portion 18. The continuous channel structure of contact 10 strengthens the contact against axial deformation of contact 10 during termination and insertion of contact 10 within an insulative connector housing. The channel and jaw structure of contact 10 also provides a contact that can be terminated with substantially no permanent spreading of insulation displacement jaws 26 or walls 30, the structure of the conductor termination portion 18 resisting plastic deformation and retaining its resiliency.

Additionally, the axially tapering profile defined by the contoured socket, transition and conductor termination portions 14, 16 and 18 facilitate insertion of contact 10 within a channel of an insulative connector housing.

Figure 6:
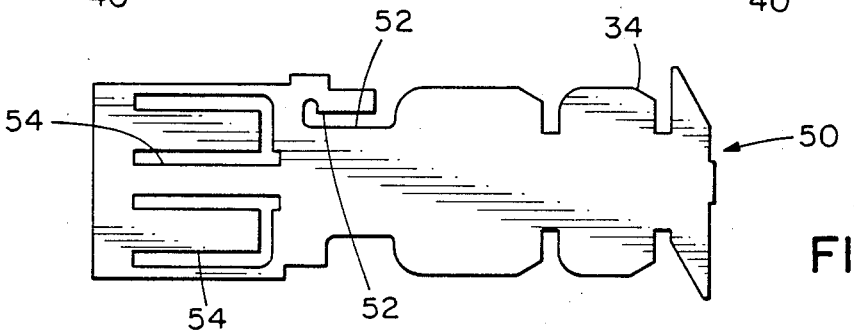
FIG. 6 is a plan of a contact blank which is stamped to form a contact of FIG. 1.

As seen in FIG. 6, contact 10 is formed from a contact blank 50 that minimizes internal or facing edges to effect simple and economical manufacture of contact 10. The only internal facing edges of contact blank 50 are edges 52 that form locking tang 24 and edges 54 that form resilient spring arms 22. Internal facing edges require the manufacture and application of tooling that is more expensive to build and maintain than tooling that forms the other non-internal edges of contact 10.

What is claimed is:

1. An insulation displacement contact adapted for post-termination insertion and retention within a channel of an insulative connector housing, comprising:

a floor extending the length of said contact;

a terminal engagement portion formed at one end of said floor which is adapted for mating engagement with a terminal;

a conductor termination portion integrally formed at the opposite end of said floor including opposing first walls coextensive with said floor and opposing insulation displacement jaws, each jaw formed from a portion of one of said first walls and each jaw including a first lateral edge and a coextensive second lateral shear edge, and wherein a wall shear edge is disposed in each of said first walls with said second lateral shear edges and said wall shear edges inclined towards said floor; and a transition portion having opposing transition walls integrally connected to said first walls and converging therefrom to integral connection with said terminal engagement portion, said floor, said first walls, and said transition walls together forming a continuous integral channel that extends from said terminal engagement portion to the opposite end of said contact whereby said contact is strengthened to resist axial deformation during termination or post-termination insertion of the contact into a connector housing.

2. An insulation displacement contact as set forth in claim 1, wherein said conductor termination portion includes at least two pairs of said jaws disposed along the length of said conductor termination portion with each pair of jaws being formed projecting away from said terminal engagement portion.

3. An insulation displacement contact as set forth in claim 2, wherein said terminal engagement portion is a box shaped pin socket presenting opposed spring arms disposed to mechanically and electrically engage a terminal pin inserted within said socket, interior side walls of said socket being integrally connected to said transition walls.

4. An insulation displacement contact as set forth in claim 3, including opposing crimpable strain relief tabs formed outwardly of and adjacent to said conductor termination portion.

5. An insulation displacement contact as set forth in claim 4, including a locking tang formed integral with said pin socket.

* * * * *